US008245425B2

(12) United States Patent
Grasmann

(10) Patent No.: US 8,245,425 B2
(45) Date of Patent: Aug. 21, 2012

(54) SETTING APPARATUS FOR DISPLACING PUSH ELEMENTS IN A SIGN DISPLAY MODULE

(76) Inventor: Josef Grasmann, Texing (AT)

( * ) Notice: Subject to any disclaimer, the term of this patent is extended or adjusted under 35 U.S.C. 154(b) by 1380 days.

(21) Appl. No.: 11/891,276

(22) Filed: Aug. 9, 2007

(65) Prior Publication Data

US 2009/0007471 A1 Jan. 8, 2009

(30) Foreign Application Priority Data

Jul. 5, 2007 (AT) ..... A 1036/2007

(51) Int. Cl.
*G09F 3/00* (2006.01)

(52) U.S. Cl. ..... 40/447; 40/446

(58) Field of Classification Search ..... 40/447, 40/446, 127, 134.2, 124.4, 134
See application file for complete search history.

(56) References Cited

U.S. PATENT DOCUMENTS 6,944,984 B1 * 9/2005 Grasmann ..... 40/447
7,234,256 B2 6/2007 Grasmann

FOREIGN PATENT DOCUMENTS

GB 2317490 A * 3/1998
WO WO 2005/043495 A1 5/2005

* cited by examiner

*Primary Examiner* — Casandra Davis
(74) *Attorney, Agent, or Firm* — Collard & Roe, P.C.

(57) ABSTRACT

A setting apparatus (1) can displace push elements (5) in a sign display module (4), with the push elements (5) each being held in the display ducts (6) of the sign display module (4) and being displaceable from a first position in which the face surfaces (5*a*) of the push elements (5) are visible on a display surface (7) of the sign display module (4) to a second position in which said face surfaces (5*a*) are arranged substantially in a non-visible way at a distance behind the display surface (7) in the sign display module (4). In order to enable a flexible and rapid setting of a sequence of signs of random length on a sign display module, at least one receptacle (8) is provided for the sign display module (4) to be set and a setting device (3) is arranged in the receptacle (8) which causes the displacement of the push elements (5) during the insertion of the sign display module (4) into the receptacle (8).

18 Claims, 9 Drawing Sheets

Detail A

Detail B

Detail C

Detail G

PRIOR ART

SETTING APPARATUS FOR DISPLACING PUSH ELEMENTS IN A SIGN DISPLAY MODULE

CROSS REFERENCE TO RELATED APPLICATIONS

Applicant claims priority under 35 U.S.C. §119 of Austrian Application No. A 1036/2007 filed Jul. 5, 2007.

BACKGROUND OF THE INVENTION

1. Field of the Invention

The present invention relates to a setting apparatus for displacing push elements in a sign display module, with the push elements each being held in display ducts of the sign display module and being displaceable from a first position in which the face surfaces of the push elements are visible on a display surface of the sign display module to a second position in which said face surfaces are arranged substantially in a non-visible way at a distance behind the display surface in the sign display module.

2. The Prior Art

The attachment of letterings such as prices, descriptions, notes, technical specifications or the like to merchandise is of particular importance nowadays. Consumers are becoming more and more demanding and wish to be informed as precisely as possible about the products that they wish to purchase. Thus it is important for the consumer to obtain information for example about the exact price, the material and the technical data of the product on the one hand, and it offers the vendor or seller of the products the advantage on the other hand that the consumer feels well-informed for the moment without any additional advice having to be given.

It is therefore certainly common practice all over the world to provide the exhibited goods in a shop display or sales locations with price tags or other kinds of lettering. The consumer can thus determine in a very simple manner in passing whether the price/performance ratio concerning specific merchandise is grounds for purchasing the article or not.

The apparatuses generally used for displaying the price are usually small rails in which individual letters or numbers printed on small plates are inserted. It is further also common practice to print price labels on paper and to attach the same to film disposed on the merchandise.

A disadvantage of these apparatuses according to the state of the art is that in the case of the rail system the vendor of the goods who wishes to mark the same with prices or other data needs to go to the respective goods with a storage box of signs (letters, numbers or symbols) in order to compose the various prices laboriously in a puzzle-like manner from the individual parts. There is a high likelihood that a number of the individual parts have already been lost or that especially the number or letter which is necessary for the price or desired text to be composed is not present because all of these numbers/letters have already been used for other goods. Generally it can be said that the vendor must always ensure that a sufficient number of individual blocks with letters, numbers or symbols are available, as otherwise a marking of the goods with the desired price or text is not possible.

The use of printed price or information labels has the disadvantage that they need to be printed first by means of suitable printing technique, must then be transported to the respective goods and must be inserted there in a sleeve. If the price labeling is wrong, the wrong label can only be replaced after a renewed printout of the label, which might possibly occur at a different location. An additional factor is that any change in the price requires the discarding of the old price tag. Especially in the case of a large number of articles the tagging of prices is thus a cumbersome task.

In order to make the mosaic-like composition of desired labels and the preparation of separately printed labels superfluous, a sign display module has already been proposed in WO 2005/043495 A1, with which all signs relevant for a specific field of application such as the numbers 0 to 9 and all special and currency signs can be displayed. The sign display module is provided with openings or display ducts which are arranged in a matrix-like manner, in which displaceable push elements are held. In order to enable changing the signs displayed on the sign display module, a setting apparatus with a receptacle for the signal display module is used, by means of which the push elements held in the sign display module can be displaced for the purpose of displaying of the sign to be displayed from a first position in which the face surfaces of the push elements are visible on a display surface of the sign display module to a second position in which said face surfaces are arranged in a substantially non-visible way at a distance behind the display surface in the sign display module.

The setting apparatus comprises grip strips plus setting templates which are provided with setting pins which are arranged in a matrix-like manner and which can be inserted into the display ducts of the sign display module by moving the grip strips towards one another. Since corresponding groups of setting pins are provided on the setting templates for each character to be displayed, the push elements can be conveyed by the associated setting pins to a desired end position for the purpose of displaying the desired sign.

It has proven to be limiting in this known setting apparatus that before or after the insertion of the sign display module into the receptacle all signs present on a sign display module need to be predetermined by means of the setting template, which also applies to the case that merely one sign of several needs to be changed. A further limitation is the fact that merely sign display modules of predetermined length or with a predetermined number of signs to be displayed can be inserted into the receptacle and therefore the sign display modules need to be adjusted to the receptacle relating to their length.

The displacement of the setting templates before each setting process has proven in practice to be time-consuming.

SUMMARY OF THE INVENTION

It is therefore the object of the present invention to provide a setting apparatus for sign display modules which allows a simple setting process.

A simple and cost-effective setting apparatus is hereby proposed, by means of which individual signs can be changed independent of other signs adjustable on the sign display module, with sign display modules of random length and sign display modules with a random number of signs being adjustable by means of the setting apparatus.

The displacement of the push elements and, as a result, the movement necessary for making the signs which can be carried out manually or automatically shall be performed by the user as simply as possible.

These objects are achieved in accordance with the invention by a setting apparatus in which a receptacle is provided for the sign display module to be set and a setting means is arranged in the receptacle which causes the displacement of the push elements during the insertion of the sign display module into the receptacle.

In a generic setting apparatus for displacing push elements in a sign display module, the push elements are held in display ducts of the sign display module which are preferably arranged as bores and are displaceable from a first position in which the face surfaces of the push elements are visible on a display surface of the sign display module to a second position in which said face surfaces are arranged substantially in a non-visible way at a distance behind the display surface in the sign display module. A receptacle for the sign display module to be set is arranged in accordance with the invention, with a setting means being arranged in the receptacle which causes the displacement of the push elements during the insertion of the sign display module into the receptacle.

As a result of this constructional arrangement of the setting apparatus, no preliminary configuration is necessary by means of setting templates in order to generate a desired sign on the sign display module.

In order to display a desired sign on the sign display module, it is merely necessary to perform a signal insertion movement into a receptacle required for this purpose, in which a movable setting means displaces the push elements of the inserted sign display module into the positions corresponding to the desired sign. Time-consuming preparation and adjustment of setting templates can thus be avoided.

A displacement process of the push elements held in the sign display module as required for producing the desired sign or sequence of signs can occur by means of the setting apparatus in accordance with the invention in a simple and rapid way, e.g. by means of a short translatory movement of the sign display apparatus sliding in the receptacle.

The simple arrangement of the setting apparatus in accordance with the invention thus allows a convenient, flexible and rapid setting of the signs to the displayed on the sign display module as compared with known setting apparatus and also enables cost-effective production.

In order to provide the setting means held in a housing of the setting apparatus with a good hold and suitable guidance, the receptacle is provided each in a preferred embodiment of the invention with an upper and a lower boundary wall and lateral boundary walls, with the distance between upper and lower boundary wall decreasing with increasing insertion depth, preferably in a V-shaped manner.

In a further preferred embodiment of the setting apparatus in accordance with the invention, the lateral boundary walls comprise guide slits for the sign display modules, along which they can be pushed into the receptacle. As a result of this simple arrangement of the housing, a cost-effective production of the setting apparatus is enabled.

In a preferred embodiment, a height of the guide slits corresponds to at least a height of the sign display module as measured between the display surface and a rear side. The clear width of the receptacle corresponds substantially to the width of the sign or a group of push elements on the sign display module forming a sign. The sign display module which can be introduced into the guide slits can therefore be arranged at any desired length and have a random number of changeable signs or groups of push elements forming a sign. The displacement of groups of push elements by means of the setting means, which groups are held in the sign display module and represent a sign, can thus occur selectively without limiting the number of signs provided on the sign display module or the number of groups of push elements because the signs of the sign display module which are not to be changed can protrude on the left or right out of the receptacle. A user of the setting apparatus in accordance with the invention can therefore move any desired section of the sign display module intended for introduction into the receptacle to a respective setting means held in the setting apparatus and change such push elements arranged in this section of the sign display module in their position in order to generate a desired sign or a desired sequence of signs.

If it is intended to change merely one digit position of a price shown on the sign display module, it is no longer necessary in future to carry out a complete new setting of all push elements held in the sign display module. Instead, it is possible to change in a purposeful manner the sign to be changed, whereas the push element of all adjacent signs (still relevant) need not be subjected to any subsequent displacement process.

In order to enable a precisely defined guidance of the sign display module introduced into the receptacle, webs with a smaller width than the guide edges are provided in a further preferred embodiment of the invention on the guide edges delimiting the guide slits. Said webs can be optionally insertable into guide shafts provided on the sign display module in order to enable a precise alignment of the sign display module in this manner.

In accordance with a further preferred embodiment of the invention, the guide slits comprise sections with different height in the direction of insertion of the sign display module, as a result of which a stop is formed in the transitional area between the two sections, with reference being made to the same further below. Said stop can be used on the one hand to delimit the insertion movement of the sign display module in the receptacle or to provide sufficient space for frames fastened to the sign display module in the rear area of the receptacles without impairing the functionality of the setting apparatus.

In order to enable a suitable forward and backward movement of the push elements displaceable in the display ducts and to enable the conveyance of the same from the first position to the second and vice-versa, the setting means comprises a pincer-like arranged gripping section in a preferred embodiment of the setting apparatus in accordance with the invention, which gripping section comprises setting pins for displacing the push elements.

The setting means is held in a displaceable manner in the receptacle in the insertion direction, with the gripping section being compressed between upper and lower boundary wall of the receptacle in the course of introducing the sign display module into the receptacles. Since the setting pins are thus insertable into the display ducts of the sign display module, an especially precise setting mechanism is realized which produces the displacement of the push elements without any additional operation by the user.

The pincer-like arranged gripping section is thus preferably provided with sliding surfaces which rest on the upper and lower boundary walls of the receptacle. This constructional measure also ensures a guidance of the setting means in the receptacle which is simple to produce and is still precise.

In accordance with a preferred embodiment of the invention, an entrainment element is provided which upon insertion of the sign display module into the receptacle causes the displacement of the setting means in the insertion direction.

In order to securely prevent the setting means inserted into the receptacle from falling out completely, the setting means is provided with at least one barb in a preferred embodiment of the invention, which barb can be latched into a holding opening provided in a preferably lateral boundary wall.

In a further preferred embodiment of the setting apparatus in accordance with the invention, the setting means comprises two lamellae which protrude apart in a V-shaped manner against the narrowing upper and bottom boundary walls. Said lamellae are made of a preferably elastic material and are compressed in the course of progressing insertion movement of the sign display module into the receptacle in a mutually converging direction. The compression of the lamellae requires a high amount of force and prevents that the setting means will slip inadvertently to the inside in the respective receptacle, e.g. when the setting apparatus is allowed to drop. In other words, the lamellae force the setting means in a defined initial position and always push in the direction of this initial position within the receptacle, in which initial position the setting means is ready for the manipulation of a sign display module.

In an especially preferred embodiment of the setting apparatus in accordance with the invention, several receptacles are provided on the same. As a result, a setting means suitable for setting a different sign can be arranged in such receptacle. For example, ten (10) receptacles plus setting means would be necessary for setting the numbers 0 to 19. There is no necessity in this embodiment to exchange individual components or setting means during the operation of the setting apparatus in accordance with the invention or to exchange setting means. The setting apparatus can be brought as a compact and handy unit to any desired place of application.

In a preferred embodiment, the setting apparatus in accordance with the invention comprises a substantially circular housing, with the receptacles being arranged in a radially extending manner, distributed over the circumference of the housing.

Since the receptacles, in a preferred embodiment, end at a distance, preferably an identical distance, to the center of the circle, a regular and especially compact configuration of the setting apparatus or the housing is obtained. The effect is especially achieved by means of the already described setting means lamellae that the lamellae which are bent successively towards each other during the insertion movement of the sign display module finally reach a narrowest point at the end of the receptacle facing the center of the circle in that the receptacles are open towards the center of the circle in order to relax again after overcoming the same in a sudden manner in a direction mutually diverging from each other and to return to their original straddled form. In an especially preferred embodiment, the receptacle plus stop can be arranged in such a way that this clearly noticeable effect coincides temporally with reaching the stop.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
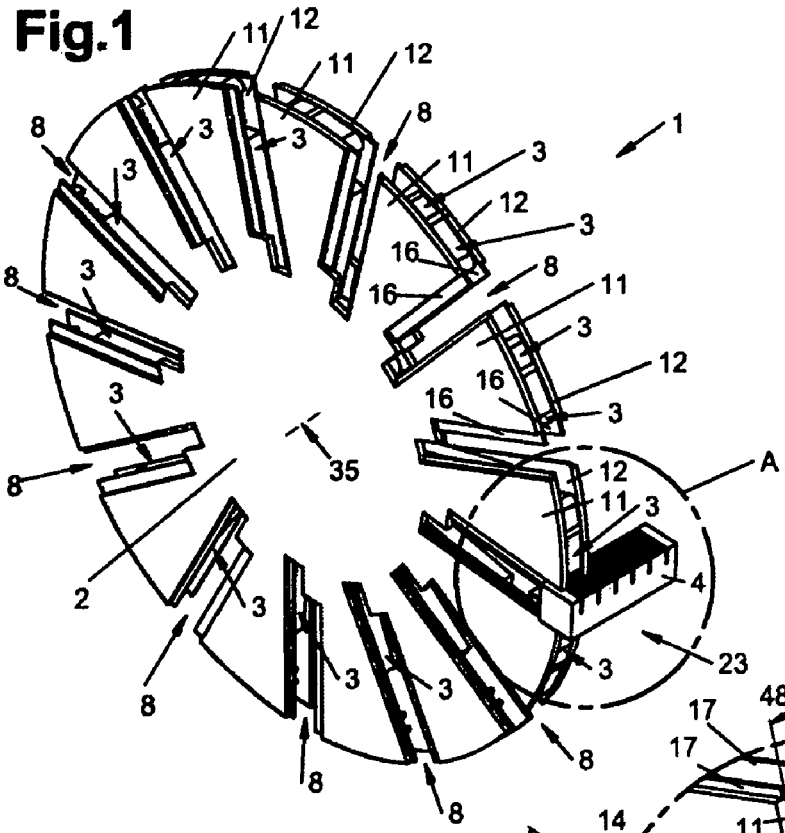
FIG. 1 shows a setting apparatus in accordance with the invention with applied sign display module in an oblique view.

FIG. 1 shows an oblique view of a setting apparatus 1 in accordance with the invention, comprising several receptacles 8 in which a sign display module 4 can be inserted in order to display on the same a desired sign such as a sequence of numbers for a price label for example.

Sign display modules 4 as used in this context are already known from the state of the art and have been disclosed in WO 2005/043495 A1 for example (see FIGS. 17 to 21).

Figure 17:
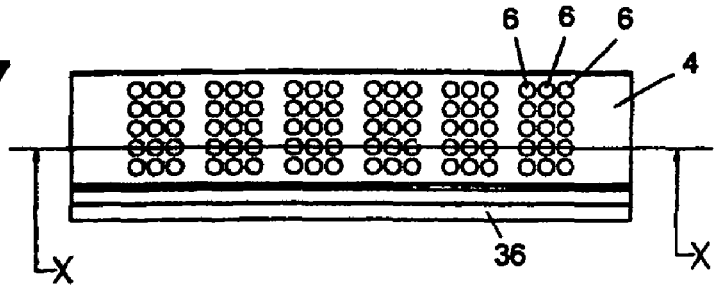
FIG. 17 shows a sign display module in accordance with the state of the art in a front view.
Figure 18:
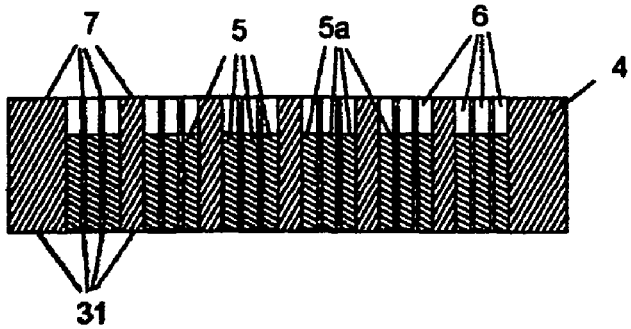
FIG. 18 shows a sectional view of a sign display module according to the state of the art along line of intersection X-X in FIG. 17.

The sign display module 4 is provided in accordance with FIG. 17 with a defined number of display ducts 6 which are arranged in the form of through-bores for example. FIG. 18 shows a sectional view along line X-X of FIG. 17. It is shown that push elements 5 are held in a displaceable manner in the display ducts 6. The length of the push elements 5 is slightly lower here than the length of the display ducts 6.

Each of the push elements 6 can be displaced optionally either to a first position in which a face surface 5*a* of the push element 5 is visible on a display surface 7 of the sign display module 4 or to a second position in which said face surface 5*a* is arranged in a substantially non-visible manner at a distance behind the display surface 7 in the sign display module 4.

Figure 19:
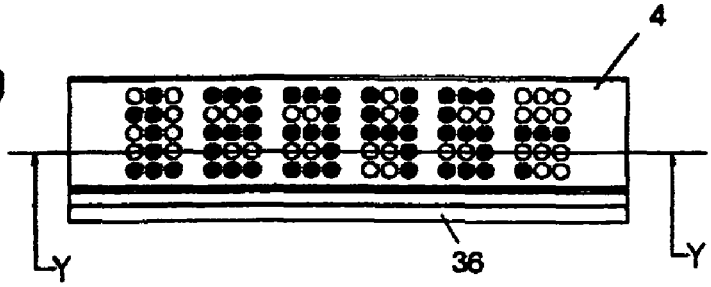
FIG. 19 shows a sign display module according to the state of the art with partly visible face surfaces of the push elements.

For each sign to be displayed there is a matrix of display ducts 6 plus associated groups of push elements. In the present embodiment this is a 3×5 matrix. In principle however the number of display ducts 6 per sign can be chosen at will. Depending on the sign to be displayed, the push elements 5 are pushed to a position in which they are visible from the display surface 7 (direction of view 37 in FIG. 21). FIG. 19 shows by way of example how the push elements 5 are displaced for this purpose, with the sequence of characters "12345.-" which is visible for the spectator being obtained from the specific configuration of the push elements.

Figure 20:
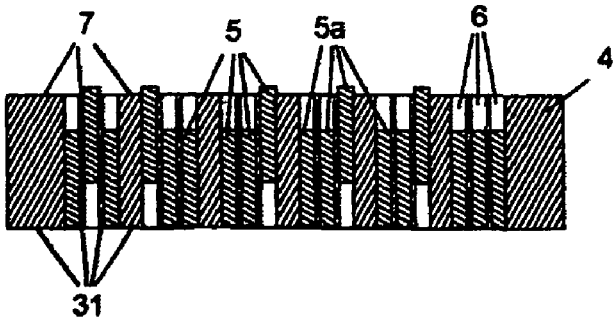
FIG. 20 shows a sectional view of a sign display module according to the state of the art along the line of intersection Y-Y in FIG. 19.

FIG. 20 shows a respective sectional view along the line Y-Y of FIG. 19, with such push elements 5 which are shown in FIG. 19 as a black dot protruding in FIG. 20 with their face surfaces 5*a* slightly from the sign display module 4 beyond the visible surface 7 and thus being better visible. It is understood that even in the case of a flush configuration of the face surfaces 5*a* of the push elements with the face surface 7 and in the case of an arrangement of the face surfaces 5*a* within the sign display module 4, i.e. slightly behind the visible surface 7, a visibility of the respective sign is ensured. In order to achieve an especially good contrast of the illustrated sign, the sign display module 4 is preferably arranged in black color, whereas the push elements 5 are arranged in white color (i.e. conversely to the drawn illustration in FIG. 19).

Figure 21:
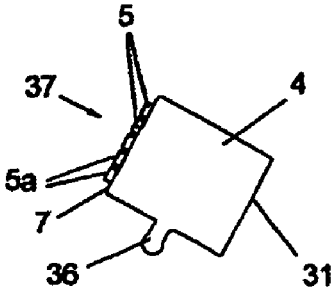
FIG. 21 shows a side view of a sign display module according to the state of the art.

FIG. 21 shows a side view of a sign display module 4 with a support lip 36 which can be used for fastening on various holding apparatuses or be provided for ensuring a more appealing angle of view of a sign display module 4 erected directly on a planar support surface.

Figure 2:
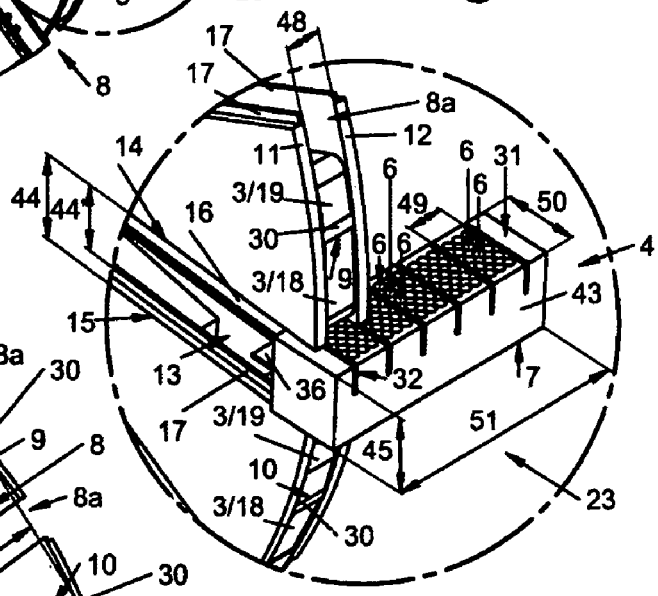
FIG. 2 shows a detail A of FIG. 1.

The sign display module 4 which is shown in detail in FIG. 2 and is provided for a setting apparatus 1 in accordance with the invention differs from the sign display module described in FIGS. 17 to 21 only in such a way that guide shafts 32 are arranged on the rear side 31 of the sign display module 4. They can be rounded off in their end sections 32 facing the display surface 7 in the direction of the width 45 of the sign display element 4 in order to enable fastening on holding apparatuses (not shown) and at the same time allow adjusting the inclination towards the spectator as a result of the end section 45 which act as a rocker.

The setting apparatus 1 in accordance with the invention is now used to displace the described push elements 5 in such a way that the signs desired by the user are displayed on the display surface 7 of the sign display module 4.

Figure 4:
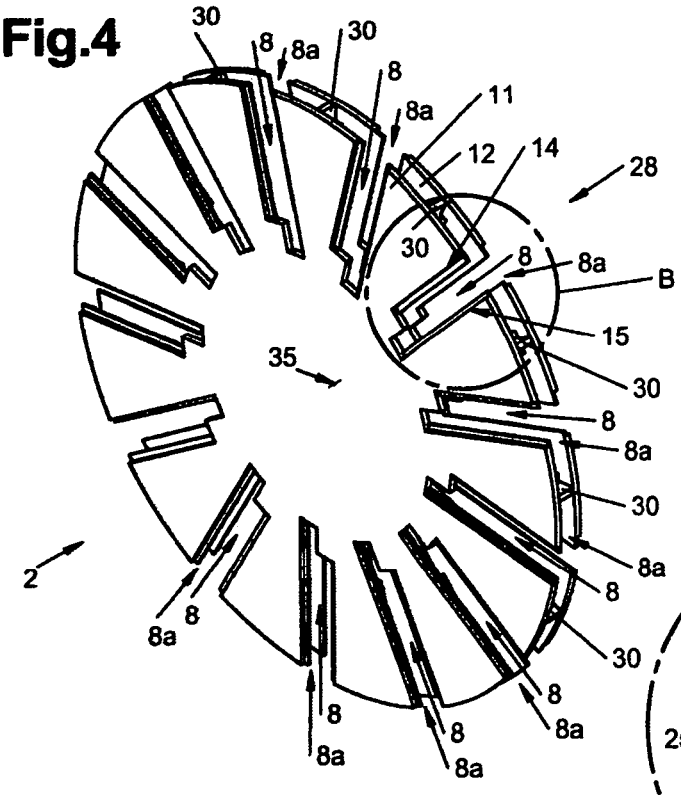
FIG. 4 shows a housing of the setting apparatus in accordance with the invention in an overall view.
Figure 5:
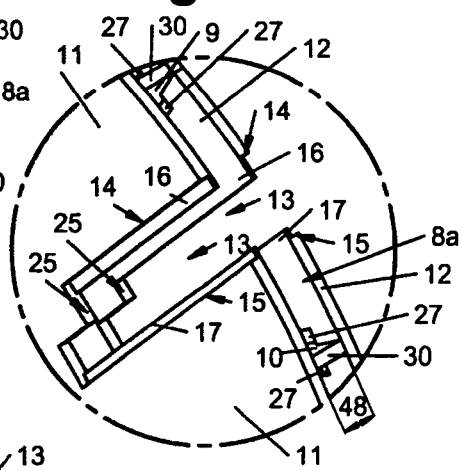
FIG. 5 shows a detail B of FIG. 4.

In the present embodiment, the setting apparatus 1 in accordance with the invention comprises a substantially circular or disk-like housing 2 in which a plurality of radially extending receptacles 8 are arranged which are distributed over the circumference of the housing 2 (see individual illustration of the housing 2 according to FIG. 4 and detailed illustration of a receptacle in accordance with FIG. 5).

The receptacles 8 each comprise in accordance with FIG. 5 (Detail "B" of FIG. 4) an upper and lower boundary wall 9, 10 and lateral boundary walls 11, 12, with the lateral boundary walls 11, 12 being provided with guide slits 13 for the sign display modules 4. The height 44, 44' of the guide slits 13 can be graduated in different ways, as in the present embodiment. The arrangement of an individual receptacle 8 is clearly apparent even on the basis of a detailed illustration according to FIG. 23.

Figure 6:
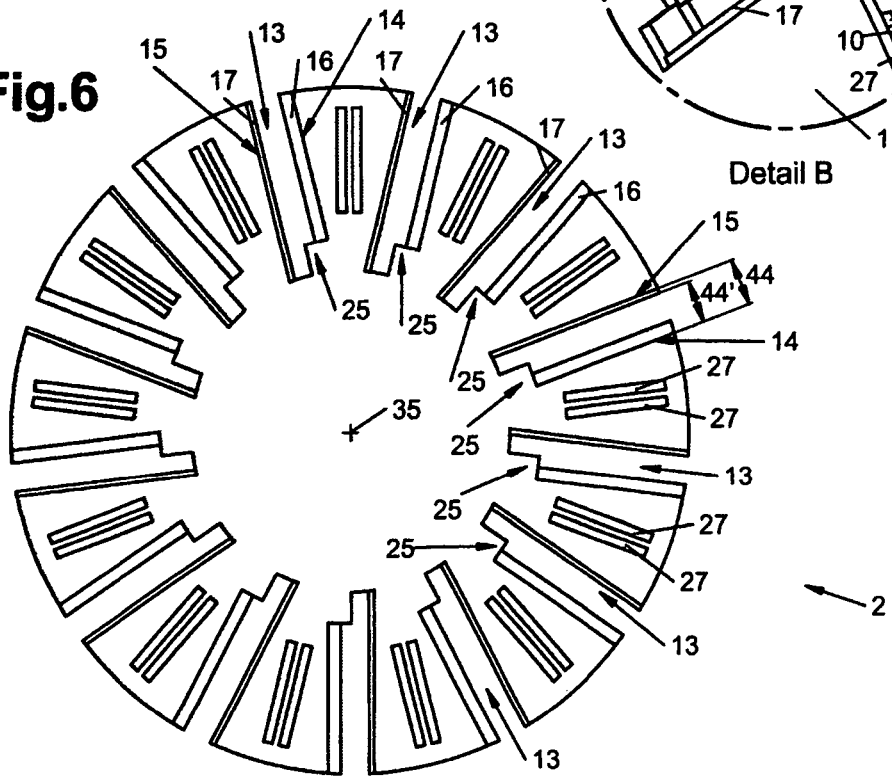
FIG. 6 shows a rear view of the housing according to direction of view 28 in FIG. 4.

The height 44 of the guide slits 13 as shown in FIGS. 2 and 6 is at least as large as the height 45 of the sign display module 4 as measured between the display surface 7 and the rear side 31, with the clear width 48 of the receptacle 8 corresponding substantially to the width of a sign 49 to be illustrated on the sign display module 4 in order to enable the lateral protrusion of the sign display module 4 from the guide slit 13 or from the receptacle 8, as is shown in FIG. 2. In this way it is possible to introduce a sign display module 4 of any desirable length or a sign display module 4 with a random number of groups of push elements showing a random sign into the receptacles 8 or into the guide slits 13.

In the present embodiment, the lateral boundary walls 11 and 12 are each joined into a uniform fan-like housing element, whereas the upper and lower boundary walls 9, 10 are each formed by spoke elements 30 extending radially to a center 35 of a circle of the housing 2. The housing is preferably of integral configuration and made of plastic, with the spoke elements 30 joining together the boundary walls 11 and 12 or the fan-like housing elements formed by the boundary walls 11 and 12.

Figure 3:
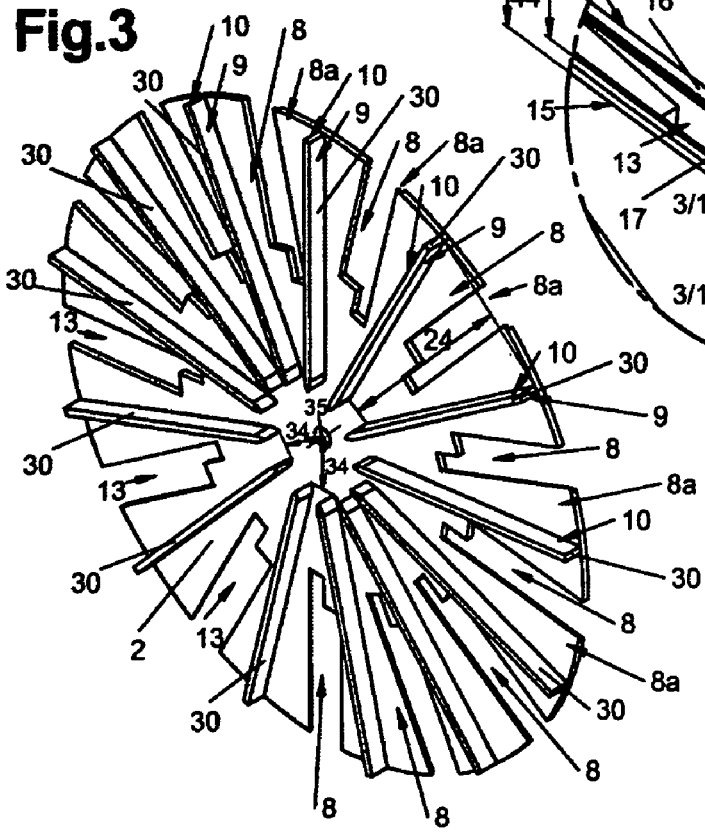
FIG. 3 shows a half of a housing of the setting apparatus in accordance with the invention.

FIG. 3 shows the principal structure of a half of a housing of a setting apparatus 1 in accordance with the invention, with the (front) lateral boundary walls 11 being omitted for the purpose of better clarity, so that it can clearly be recognized how the spoke elements 30 subdivide the housing 2 into a defined number of receptacles 8. FIG. 3 further shows that the distance between the upper and bottom boundary wall 9, 10 of each receptacle decreases in a V-like manner with increasing insertion depth 24. The V-shaped receptacles 8 end with a preferably identical distance 34 to the center 35 of the circle of housing 2, with the receptacles 8 being open towards the center 35 of the circle.

The mentioned guide slits 13 are defined by opposite guide edges 14, 15 of the lateral boundary walls 11, 12, with webs 16, 17 being provided on said guide edges 14, 15 which have a lower width than the guide edges 14, 15 or are thinner than the same (see FIGS. 5 and 6). The first webs 16 have a larger height than the second webs 17, with the second webs 17 being predetermined for making direct contact with the display surface 7 of the sign display module 4, whereas the first webs 16 are determined for engagement in the guide shafts 32 of the sign display module 4 which are arranged on the rear side 31 (see FIG. 2). The important aspect is in this case that the display ducts 6 on the display surface 7 of the sign display module 4 are not obstructed by the guide edges 15 or the second webs 17 in order to enable a slight protrusion of the face surfaces 5*a* of the push elements beyond the display surface 7 for an improved contrast effect (as shown in FIG. 20) during the displacement of the push elements 5.

Since the sign display module 4 therefore slides on the second webs 17, it is more precisely the height 44' of the guide slits 13 as shown in FIG. 2 in the present embodiment which corresponds to the height 45 of the sign display module 4.

Preferably, the first webs 16 (as shown in FIG. 1) have the same height. For reasons of production and injection molding one of the first webs 16 which are opposite in pairs can have a lower height than the other one (as shown in FIG. 5).

In accordance with the invention, setting means 3 for the sign display module 4 to be set are arranged in the receptacles 8, which setting means cause a displacement of the push elements 5 of a sign to a desired position in the introduction of the sign display module 4 into the receptacle 8.

Figures 7, 8:
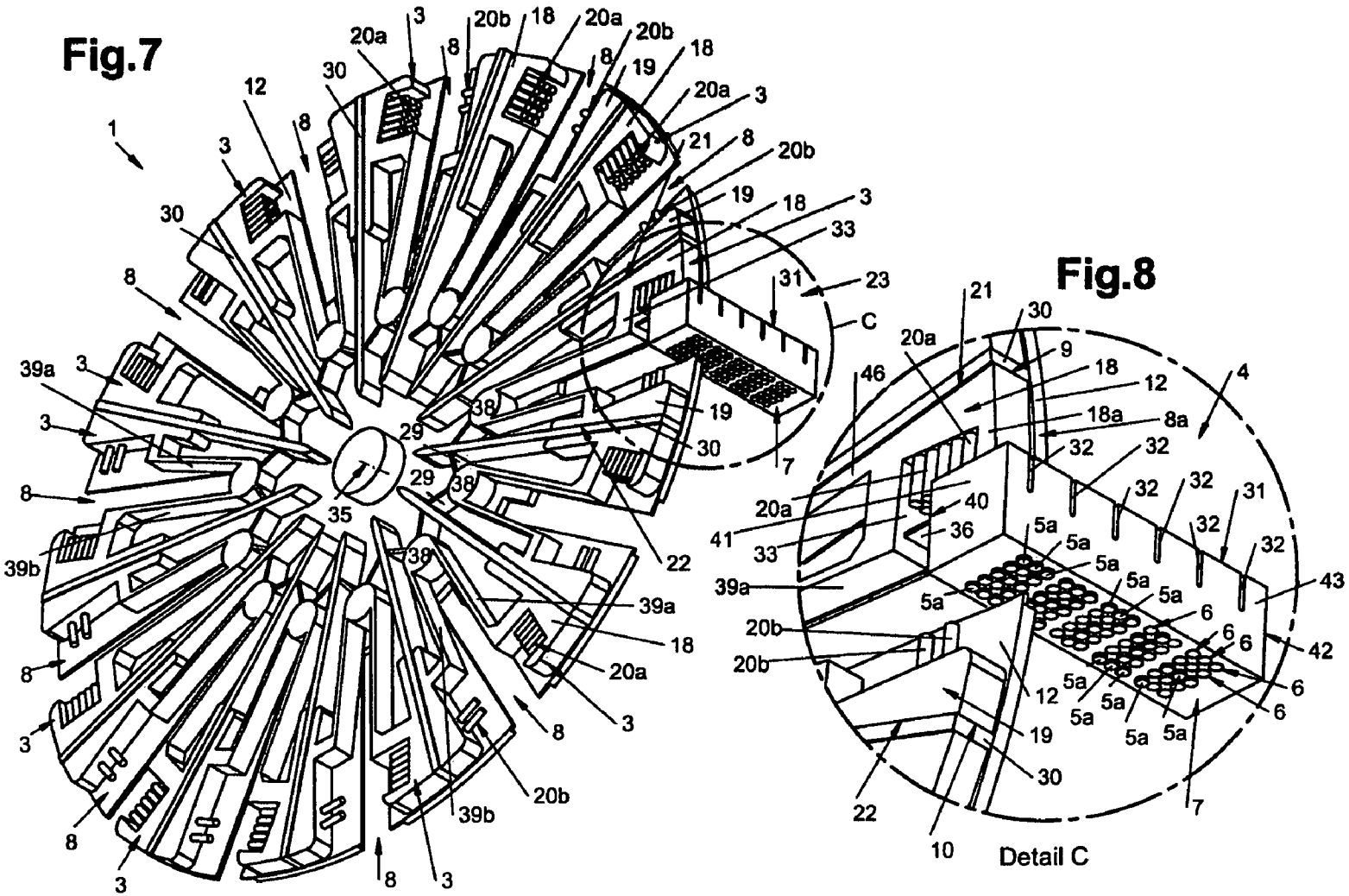
FIG. 7 shows a half of a housing of a setting apparatus in accordance with the invention equipped with setting means in an oblique view, with the setting means being in an initial position.
FIG. 8 shows a detail C of FIG. 7.

FIG. 7 shows a mere example of a setting apparatus with thirteen receptacles 8, with a setting means being arranged in each receptacle 8 (again by omitting the front lateral boundary walls 11). Each of the setting means 3 comprises a two-part, pincer-like gripping section 18, 19 on which setting pins 20*a*, 20*b* are arranged for displacing the push elements 5 (also see an individual illustration of the setting means 3 in accordance with the invention in FIG. 22). The setting means 3 is held in a displaceable manner in the receptacle 8 in the direction of introduction 23 or in the direction of the center 35 of the circle.

The setting means 3 made of technical plastic or polyoxymethylene (POM) for example is preferably of integral configuration and comprises a cartilage-like base section 38, from which two elastic arms 39*a*, 39*b* lead away in a slightly diverging direction. At the end sections of the arms 39*a*, 39*b* which are opposite to the cartilage-like base section 38 there is finally the pincer-like arranged gripping section 18, 19, with a shoulder-like entrainment element 33 being provided on the setting means 3 which upon insertion of the sign display module 4 into the guide slit 13 causes the displacement of the setting means 3 in the direction of insertion 23. The base section 38 is further provided with lamellae 29 which protrude in a V-shaped manner apart from one another against the narrowing upper and lower boundary walls 9, 10.

FIGS. 7 and 8 show how the sign display module 4 inserted into the receptacle 8 or in the guide slit 13 meets with a bottom side 40 the shoulder-like entrainment element 33 of setting means 3 which is in an initial position and thus subsequently presses the entire setting means 3 deeper into the V-shaped narrowing receptacle 8 or in the direction of the center 35 of the circle. A sufficient clearance of the entrainment element 33 is ensured in that an end section 18*a* of the first gripping section 18 which is adjacent to the (peripheral) receptacle opening 8*a* and its setting pins 20*a* have a lower height than the entrainment element 33 (also see FIG. 12).

Figure 22:
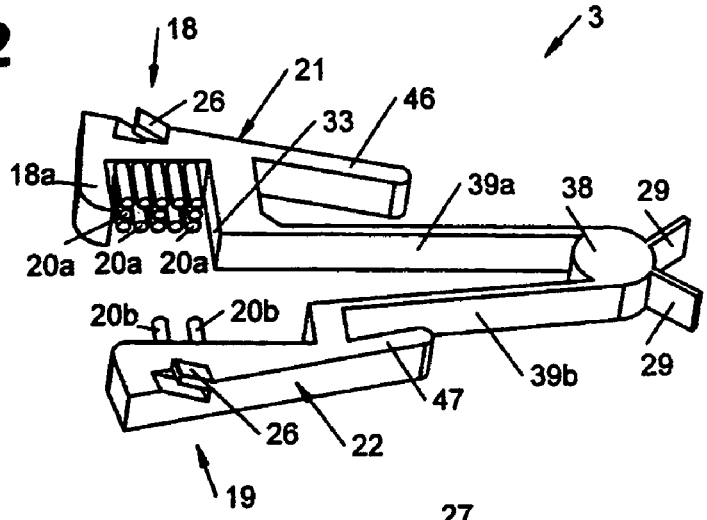
FIG. 22 shows a setting means in accordance with the invention in an isometric individual view.

As is shown especially in FIG. 22, the gripping sections 18, 19 comprise sliding surfaces 21, 22 which rest during the entire setting process on the upper and lower boundary walls 9, of the receptacle 8 or on the spoke elements 30. In order to enable optimal guidance of the gripping sections 18, 19 in the receptacle 8, the gripping sections 18, 19 comprise peg-like guide noses 46, 47 which extend the sliding surfaces 21, 22.

During the insertion of the sign display module 4 into the guide slits 13 it needs to be ensured that the guide shafts 32 arranged on the rear side 31 of the sign display module 4 are brought into engagement with the first webs 16 of the lateral boundary walls 11, 12. As a result of the custom-fit pairing of the guide shafts 32 with the first webs 16, an alignment of the sign display module 4 is ensured which corresponds to the position of the setting pins 20*a*, 20*b*. In this alignment of the sign display module 4 (when the bottom side 40 of the sign display module rests on the shoulder-like entrainment element 33), the axes of the push elements 5 or the axes of the display ducts 6 are substantially in alignment with the corresponding axes of the setting pins 20*a*, 20*b* of the gripping sections 18, 19 which are also arranged in a matrix-like manner, so that an introduction of the setting pins 20*a*, 20*b* into said display ducts 6 is possible.

In the present embodiment, the sliding surfaces 21, 22 of the gripping sections 18, 19 which slide on the boundary walls 9, 10 are inclined in such a way or the setting pins 20*a*, 20*b* are aligned in such a way relative to the sliding surfaces 21, 22 that the axes of the setting pins 20*a*, 20*b* are in alignment in each position during the setting process with the axes of the display ducts 6. The axes of the setting pins 20*a*, 20*b* therefore extend in the present embodiment of the setting apparatus 1 in accordance with the invention always in an orthogonal manner relative to the guide edges 14, 15 or to the edges of webs 16, 17.

Figure 9:
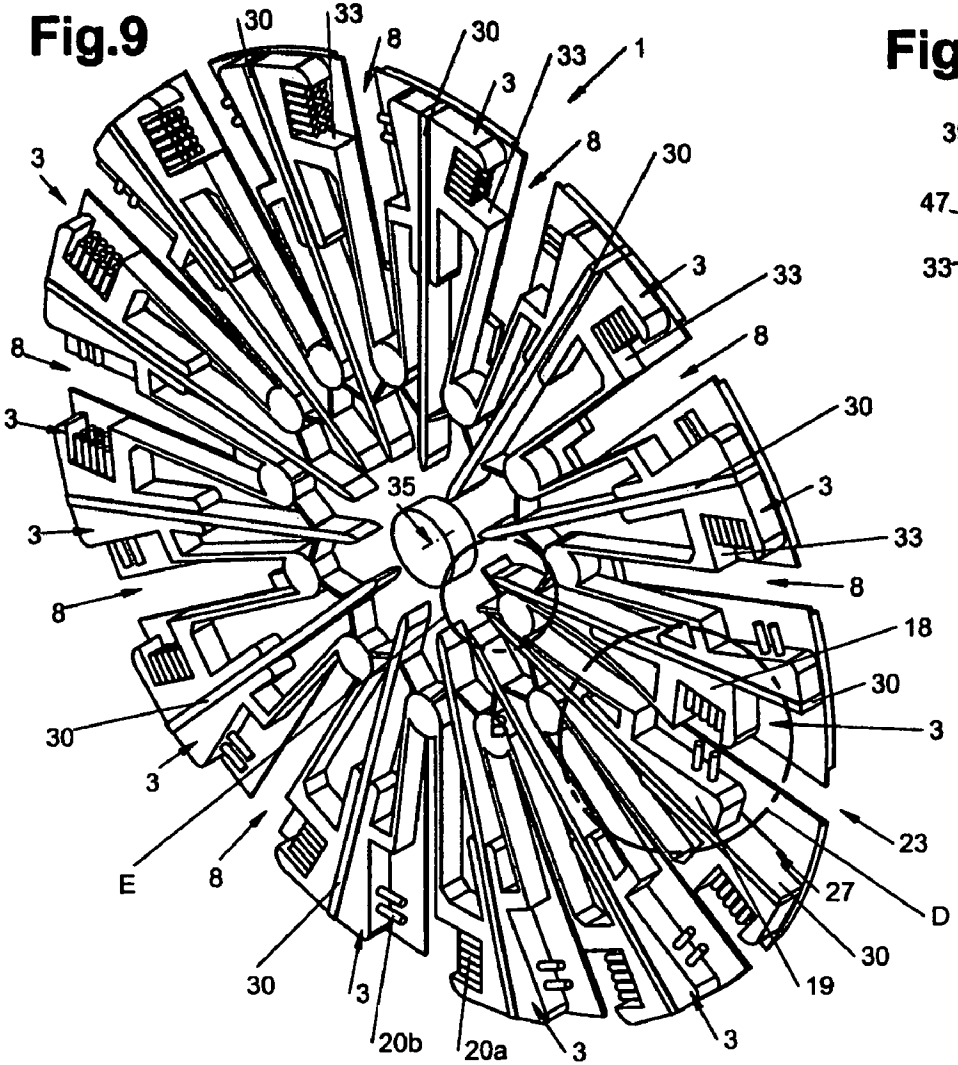
FIG. 9 shows a half of a housing of a setting apparatus in accordance with the invention equipped with setting means in an oblique view, with one of the setting means being situated in an end position (without sign display module)

Since a sign display module 4 in accordance with FIG. 7 has been introduced in the direction of insertion 23 into the guide slit 13 or has been brought into contact with a setting means 3, the setting means 3 is brought to an end position according to FIG. 9 by a continued translatory movement in the direction of the center 35 of the circle of the housing. The movement of the setting means 3 to its end position is exclusively caused by pressing in the sign display module 4 into the guide slit 13, e.g. by manually grasping the sign display module 4 on its side surfaces 41, 42 with the thumb and index finger.

Figure 10:
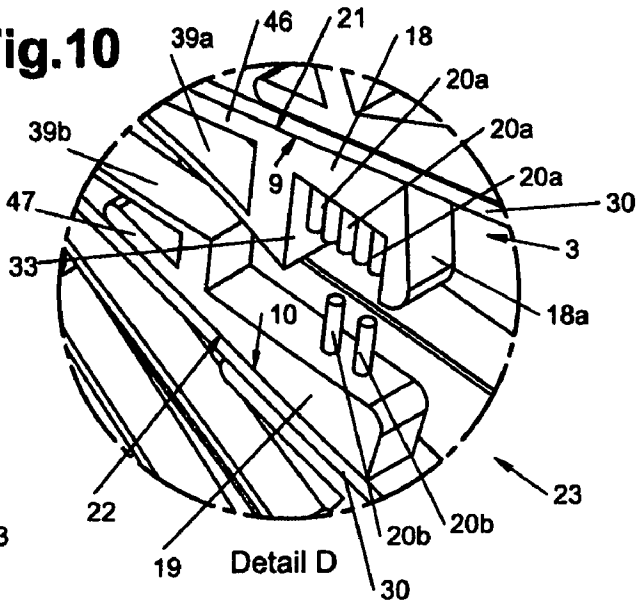
FIG. 10 shows a detail D of FIG. 9.

It is clear from FIG. 9 how the gripping sections 18, 19 are subject to a forced guidance by the spoke elements 30 or by the upper and lower boundary wall 9, 10 during the movement of the setting means 3 (arranged at the bottom right-hand corner in (FIG. 9) from the initial position to the end position and are thus successively guided towards one another until the setting pins 20*a*, 20*b* of the gripping sections 18, 19 are situated at a desired distance from each other in which they protrude into the display ducts 6 of the sign display module 4 and move the push elements 5 of the sign display module 4 (not shown in FIG. 9 for reasons of clarity) to the desired end position. In this end position of the setting means 3 or the setting pins 20*a*, 20*b*, which is shown in FIG. 10 in detail, the setting process of the push elements 5 of the sign display module 4 (which is also not shown in FIG. 10) is completed. At this time, the end section 18*a* of the first gripping section 18 partly overlaps an upper side 43 of the sign display module 4 (also see FIG. 14).

When the sign display module 4 is pulled out of the receptacle 8 or from the guide slit 13 against the direction of insertion 23, the sign "8" can be read in the matrix of push elements 5 in accordance with the invention which was previously situated in receptacle 8 because the push elements 5 corresponding to the setting pins 20*a* of the first gripping section 18 arranged in the form of the number "8" have been displaced to such an extent in the direction of the display surface 7 or beyond the display surface 7 of the sign display module 4 that the face surfaces 5*a* of said push elements 5 are now well visible to a spectator of the display surface 7, whereas those push elements 5 which were contacted by the setting pins 20*b* of the second gripping section 19 were pushed to such an extent behind the display surface 7, i.e. in the direction of the rear side 31 of the sign display module 4, that they are not visible to a spectator of the display surface 7 and that as a result of the insertion depth of said push elements 5 into the display ducts 6 and the concomitant shadowing there is no relevant optical contrast anymore.

Figure 12:
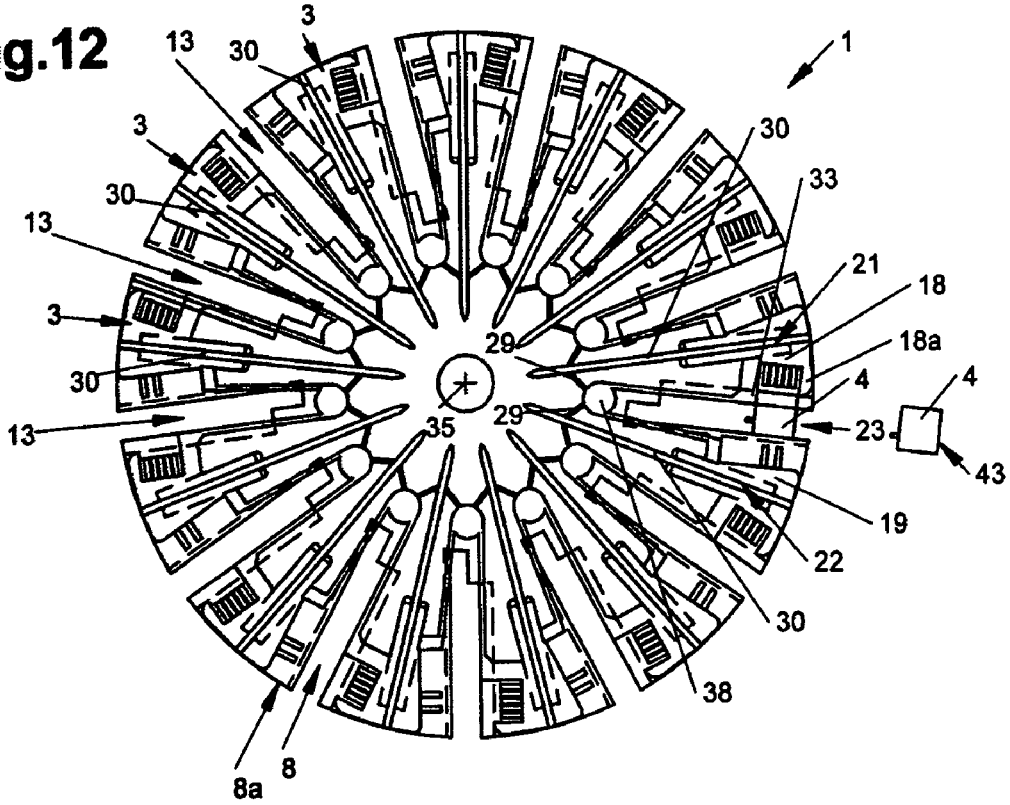
FIG. 12 shows a half of a housing of a setting apparatus in accordance with the invention equipped with setting means in a front view, with the setting means being in an initial position.
Figure 13:
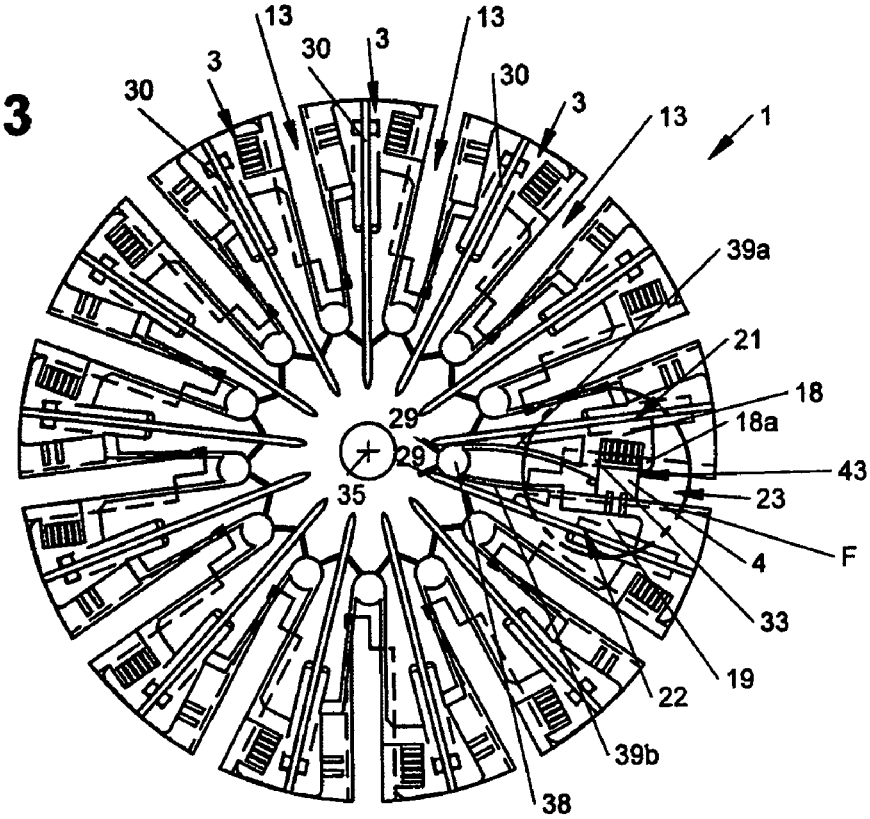
FIG. 13 shows a half of a housing of a setting apparatus in accordance with the invention equipped with setting means in a front view, with one of the setting means being situated in an end position (plus sign display module)
Figure 14:
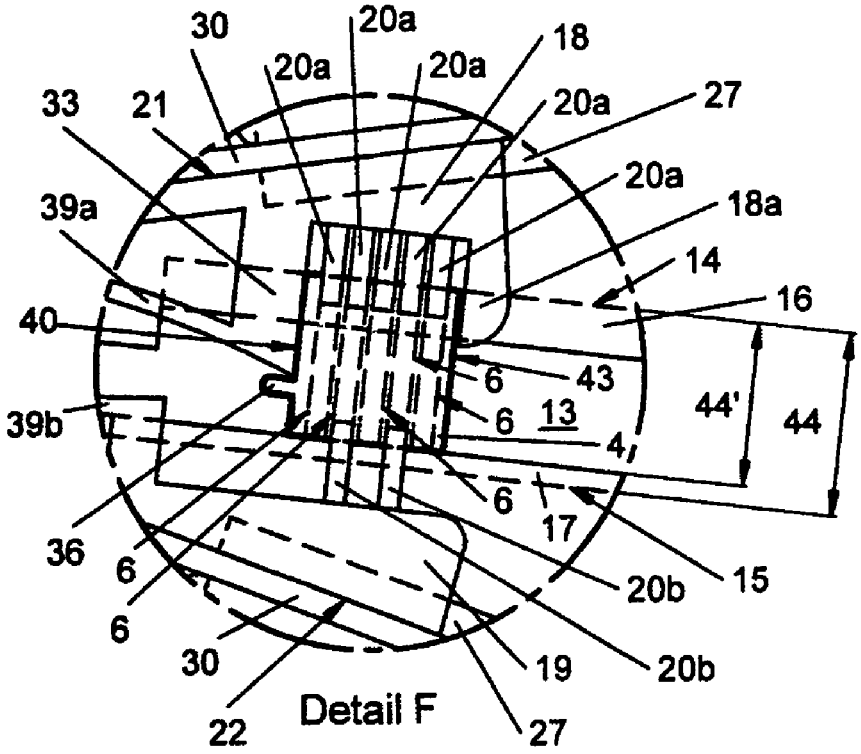
FIG. 14 shows a detail F of FIG. 13.

The described setting process can also be understood by reference to FIGS. 12 to 14 (by illustrating the sign display module 4):

FIG. 12 shows a top view of the setting apparatus 1 without a front boundary wall, with a sign display module 4 being moved in the insertion direction 23 towards a setting means 3 arranged in the "3 o'clock" position. The sign display module 4 has also been entered in a position in which it is in contact with its bottom side 40 with the shoulder-like entrainment element 33 (at this time the setting means 3 is still situated in its initial position).

As a result of the decreasing distance between upper and bottom boundary wall 9, 10, the gripping sections 18, 19 are compressed with continued movement of the sign display module 4 in the insertion direction 23 and the setting pins 20*a*, 20*b* are introduced into the display ducts 6 of the sign display module 4 until the setting means 3 or the setting pins 20*a*, 20*b* are situated in an end position as shown in FIG. 13. In this end position which is shown in FIG. 14 in closer detail, the push elements 5 (not shown) are configured by the mutual engagement of the setting pins 20*a*, 20*b* in a manner that a desired sign is obtained on the display surface 7 of the sign display module 4 (shown in bold print).

It is possible but not necessary to press the sign display module 4 up to a stop 25 of the guide slit 13 further in the insertion direction 23. In such a case, the elastic arms 39*a*, 39*b* of the setting means 3 would arch even more than shown in FIG. 13.

In other words, the stop 25 can be used to mark the end of the insertion movement of the sign display module 4 which is necessary for setting the push elements 5, i.e. only when the sign display module 4 has reached the stop 25 will the push elements be situated in their correct end position.

As an alternative to this, the geometrical configuration of the receptacle 8 plus guide slits 13 can also occur in such a way that the stop 25 does not define the end position in which the push elements 5 have reached their end position.

It is also possible to provide the receptacles 8 without stop 25. The guide slits 13 can be arranged in this case with a constant height 44.

Figure 23:
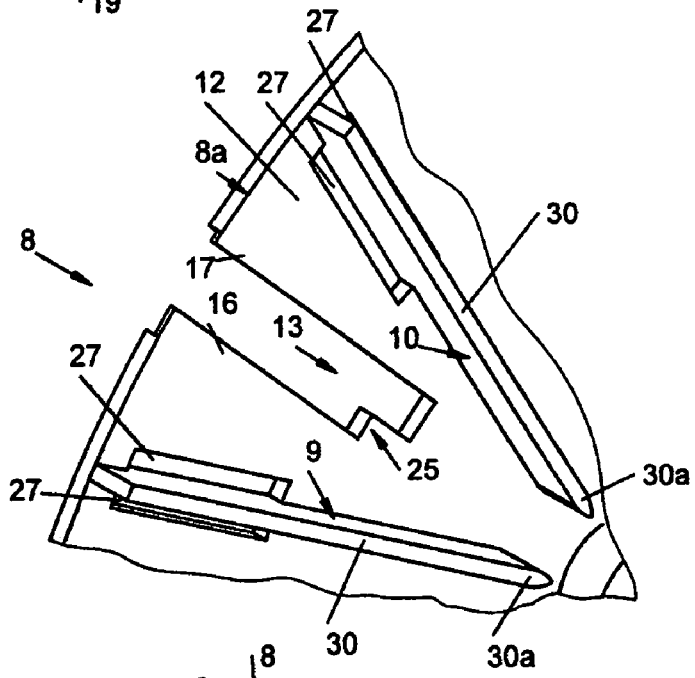
FIG. 23 shows a receptacle in accordance with the invention in an isometric individual view.
Figure 24:
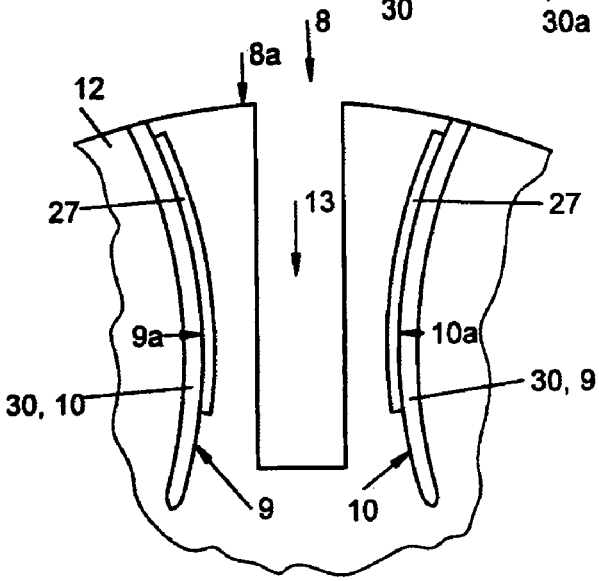
FIG. 24 shows an alternative version of a receptacle in accordance with the invention in an isometric individual view.

The boundary walls 9, 10 or the spoke elements 30 in the lateral boundary walls 11, 12 can be arranged as shown in FIG. 23 or be arranged as diverging curves in an alternative embodiment as shown in FIG. 24. In this case, those points 9*a*, 10*a* with the smallest clearance between the curves would define the position in which the desired setting of the push elements 5 has been made. The further introduction of a sign display module 4 into the receptacle 8 would then not cause any further change in the position of the push elements 5 due to the then again mutually distancing curves. The distance between upper and bottom boundary wall 9, 10 decreases thus with increasing insertion depth 24 merely up to such position of the sign display module in which the required setting of the push elements 5 has been made.

A withdrawal of the sign display module 4 from the receptacle 8 or from the guide slit 13 causes simultaneously a conveyance of the setting means 3 to its initial position because the sign display module 4 presses with its upper side 43 against the end section 18*a* of the first gripping section 18 during its withdrawal against the direction of insertion 23 (see FIGS. 13 and 14) and thus entrains the gripping section 18 and thus the entire setting means 3 and conveys the same back to the initial position according to FIG. 12. At the same time, the lamellae 29 press the sign display module 4 to the initial position.

The described setting process can now be repeated for any group or matrix of push elements arranged on the sign display module 4, so that the sequence of numbers "8271.-" is obtained according to FIG. 8 for example. Since the setting of the respective groups of push elements by means of the setting apparatus 1 in accordance with the invention occurs separately, i.e. independent from the setting adjacent groups of push elements, the number of groups of push elements arranged on the sign display module 4 or the number of signs to be displayed is not subject to any limits. FIG. 8 shows by way of an example a sign display module 4 with five groups of push elements or with six guide shafts 32.

Notice must be taken further that the setting means 3 are shown in a uniform manner in the present figures for the sake of simplicity, i.e. they have the same arrangement of setting pins 20*a*, 20*b*. In practice however, each of the setting means 3, of which in the present embodiment there are thirteen, will obviously have a different arrangement of setting pins 20*a*, 20*b* in order to enable the setting of all numbers 0 to 9 and any special or currency signs with a single setting apparatus 1. Since each receptacle 8 is provided for a different sign, a compact and versatile setting apparatus 1 can be provided.

The mentioned lamellae 29 of the setting means 3 which protrude apart in a V-shaped manner against the narrowing upper and lower boundary walls 9, 10 lead to an increased amount of pressure to be applied in the insertion of the sign display module 4 and prevent that the setting means 3 will inadvertently slip in the respective receptacle 8 to the inside, e.g. when the setting apparatus 3 is allowed to drop. In other words, the lamellae 29 force the setting means 3 into a defined initial position or always push in the direction of said initial position within the receptacle 8, in which initial position the setting means is ready for the manipulation of a sign display module 4.

Figure 11:
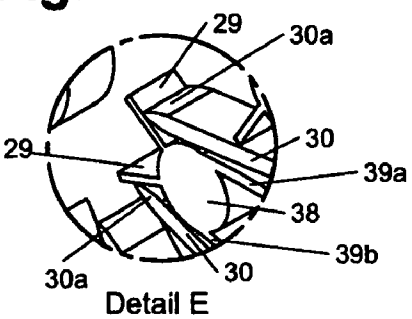
FIG. 11 shows a detail E of FIG. 9.

In addition, the lamellae 29 can signalize to the user through a snap-on effect that an end position of the setting means 3 has been reached or will be reached soon in which the desired setting of the push elements on the sign display module 4 has been completed and the sign display module 4 can be guided out of the receptacle 3 or out of the guide slit 13 against the direction of insertion 23. Such a snap-on effect is produced in that the elastic lamellae 29 which are successively bent against each other during the insertion movement of the sign display module 4 finally reach a dead point at the end of the receptacle 8 facing the center 35 of the circle and, after overcoming the same, relax again in a direction diverging from one another in a sudden manner and return to their originally straddling form. FIG. 11 shows such a position of the lamellae 29 after overcoming the end point formed by needle-shaped tapering end sections 30*a* of the spoke elements 30, with the setting means 3 being situated in its end position setting the sign display module 4.

During the withdrawal of the sign display module 4 from the receptacle 8 against the direction of insertion 23, the user needs to overcome a brief resistance because the lamellae 29 are pressed against each other again by the needle-shaped end sections 30*a* of the spoke elements 30 and are only able to expand again after overcoming an end point.

Figure 15:
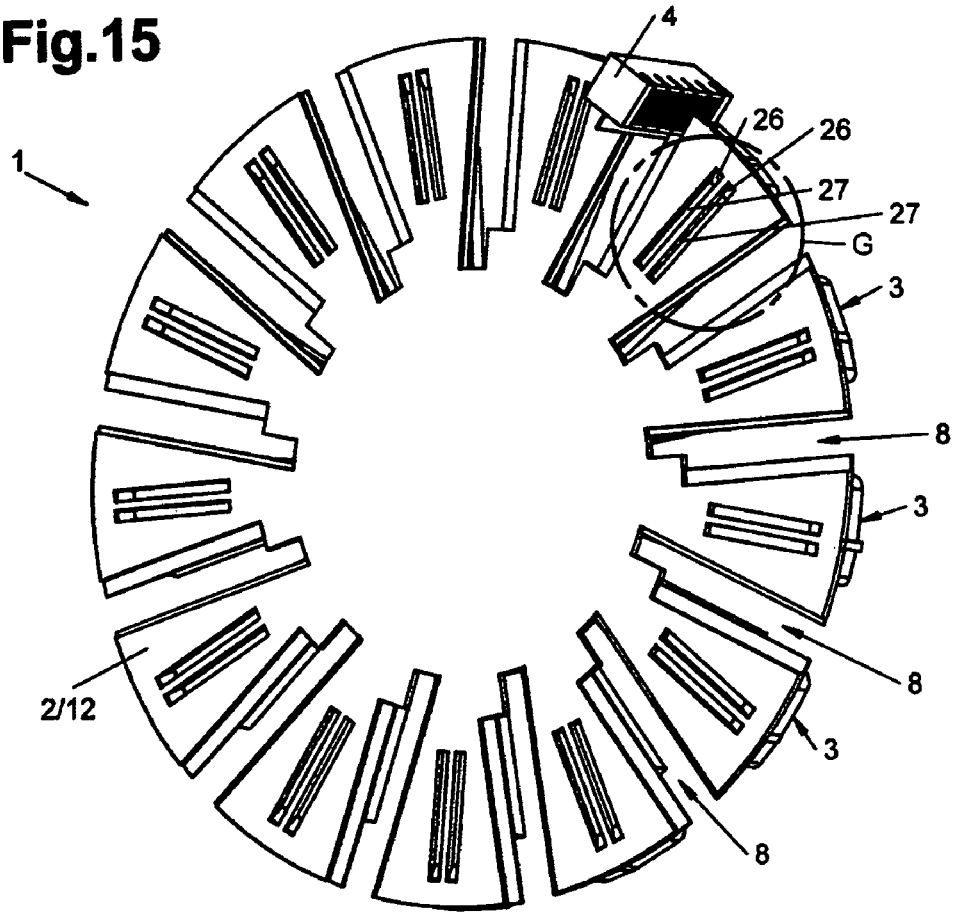
FIG. 15 shows a setting apparatus in accordance with the invention, with the setting means being provided with barbs guided in holding openings of the housing.
Figure 16:
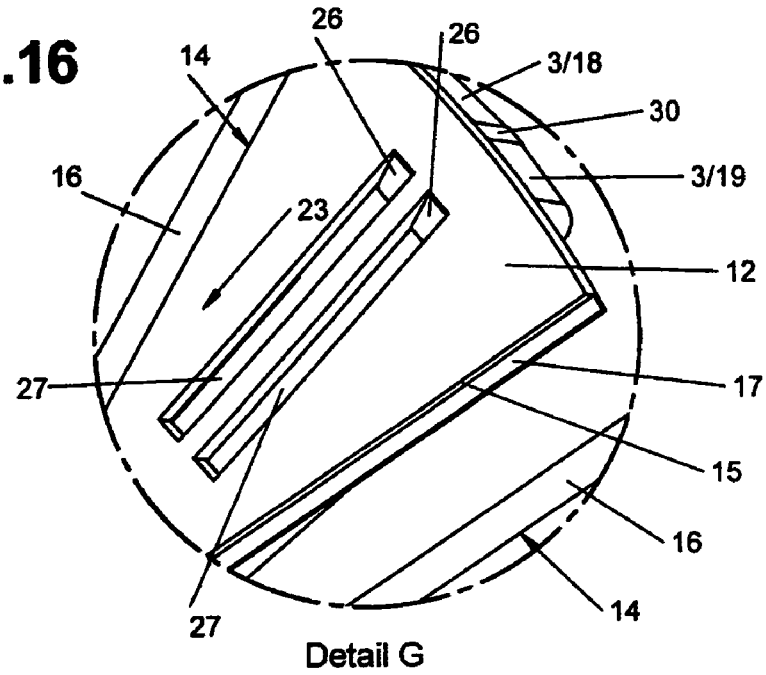
FIG. 16 shows a detail G of FIG. 15.

In a preferred embodiment, the gripping sections 18, 19 of each setting means 3 are provided with a barb 26 which can be latched in a holding opening 27 provided on the lateral boundary wall 12 (see FIGS. 22 and 23). FIG. 15 shows a rear view of the setting apparatus 1 as shown in FIG. 7, with a detailed illustration according to FIG. 16 showing in particular how the barbs 26 latched into the holding openings 27 prevent the setting means 3 inserted in the receptacle 8 from falling out. The holding openings 27 extend parallel to the spoke elements 30 and are directly adjacent to the same in the present embodiment. A secure guidance of the setting means 3 is ensured during the entire movement process of the setting means 3 from the initial position to its end position and back again. Moreover, the provision of the barbs 26 guided in the holding openings 27 ensures that the gripping sections 18, 19 are guided back to a complete opened position during the return movement of the setting means 3 from its end position to its initial position, which opened position might be prevented by plastic bending of the arms 39*a*, 39*b* of the setting means 3 or by the (deformed) setting means 3 remaining excessively long in its end position.

It is understood that numerous variations are possible in connection with the presented embodiment of the setting apparatus 1 in accordance with the invention without departing from the inventive principle. It would be possible for example that the push elements 5 held in the sign display module 4 are calibrated at a suitable guide surface during the insertion of the sign display module 4 into the receptacle 8 and merely a single gripping section 18 is provided on the setting means 3, which gripping section engages in the rear side 31 of the sign display module 4 and which conveys selected push elements 5 from a first (invisible) position to a second (visible) position.

Similarly, the push elements 5 could also be provided with an angular or polygonal configuration instead of a pin-like configuration, with individual push elements 5 also having entire or partial shapes of desired signs, e.g. of currency signs.

The invention extends in particular not only to the circular setting apparatus with radially arranged receptacles but principally also to any arrangement of a receptacle in accordance with the invention in a housing, which may also include a setting apparatus with merely one receptacle in a housing.

LIST OF REFERENCE NUMERALS

1 Setting apparatus
2 Housing
3 Setting means
4 Sign display module
5 Push elements
5*a* Face surfaces of the push elements
6 Display ducts
7 Face surface
8 Receptacle
8*a* (Peripheral) receptacle opening
9 Upper boundary wall
10 Lower boundary wall
11 Lateral boundary wall
12 Lateral boundary wall
13 Guide slits
14 Guide edges
15 Guide edges
16 Webs
17 Webs
18 First gripping section
19 Second gripping section
20*a* Setting pins of the first gripping section 18
20*b* Setting pins of the second gripping section 19
21 Sliding surface (on the first gripping section 18)
22 Sliding surface (on the second gripping section 19)
23 Direction of insertion
24 Insertion depth
25 Stop
26 Barb
27 Holding opening
28 Direction of view
29 Lamellae
30 Spoke element
31 Rear side of the sign display module
32 Guide shafts on the sign display module
33 Entrainment element
34 Distance to the center 35 of the circle
35 Center of the circle
36 Support lip
37 Direction of view
38 Base section of setting means 3
39*a* Arms of setting means
39*b* Arms of setting means
40 Bottom side of sign display module
41 Lateral surface of sign display module
42 Lateral surface of sign display module
43 Upper side of sign display module
44 Height of guide slit 13
45 Height of display module 4
46 Guide nose of setting means 3
47 Guide nose of setting means 3
48 Clear width of receptacle 8
49 Width of a sign on the sign display module 4
50 Depth of sign display module
51 Width of sign display module

The invention claimed is:

1. A setting apparatus (1) for displacing push elements (5) in a sign display module (4), with the push elements (5) each being held in the display ducts (6) of the sign display module (4) and being displaceable from a first position in which the face surfaces (5*a*) of the push elements (5) are visible on a display surface (7) of the sign display module (4) to a second position in which said face surfaces (5*a*) are arranged substantially in a non-visible way at a distance behind the display surface (7) in the sign display module (4), the setting apparatus comprising a receptacle (8) for the sign display module (4) to be set and a setting device (3) arranged in the receptacle (8), wherein the setting device causes the displacement of the push elements (5) during the insertion of the sign display module (4) into the receptacle (8).

2. The setting apparatus according to claim 1, wherein the receptacle (8) comprises an upper and lower boundary wall (9, 10) and lateral boundary walls (11, 12) each, and the distance between the upper and lower boundary wall (9, 10) decreases with increasing insertion depth (24), preferably in a V-like manner.

3. The setting apparatus according to claim 2, wherein the lateral boundary walls (11, 12) comprise guide slits (13) for the sign display modules (4).

4. The setting apparatus according to claim 3, wherein a height (44, 44') of the guide slits (13) corresponds to at least a height (45) of the sign display module (4) as measured between the display surface (7) and a rear side (31).

5. The setting apparatus according to claim 3, wherein the guide slits (13) comprise sections of different height (44, 44'), as seen in an insertion direction (23) of the sign display module (4).

6. The setting apparatus according to claim 3, wherein each guide slit (13) is delimited by two mutually opposite guide edges (14, 15) which are arranged as diverging curves.

7. The setting apparatus according to claim 3, wherein webs (16, 17) with a smaller width than the guide edges (14, 15) are provided on the guide edges (14, 15) which delimit the guide slits (14, 15).

8. The setting apparatus according to claim 2, wherein the setting device (3) is held in a displaceable manner in the receptacle (8) in the direction of insertion (23) and the gripping section (18, 19) is compressed between upper and bottom boundary wall (9, 10) as a result of the decreasing distance between upper and lower boundary wall (9, 10) during the insertion of the sign display module (4) into the receptacles (8), as a result of which the setting pins (20*a*, 20*b*) can be introduced into the display ducts (6) of the sign display module (4).

9. The setting apparatus according to claim 2, wherein the setting device (3) comprises two lamellae (29) which protrude apart in a V-like manner against the narrowing upper and lower boundary walls (9, 10).

10. The setting apparatus according to claim 1, wherein the receptacle (8) has a clear width substantially corresponding to a width of a sign on the sign display module (4).

11. The setting apparatus according to claim 1, wherein the setting device (3) comprises a gripping section (18, 19) which is arranged in a pincer-like manner and on which setting pins (20*a*, 20*b*) are arranged which are provided for displacing the push elements (5).

12. The setting apparatus according to claim 11, wherein the gripping section (18, 19) which is arranged in a pincer-like manner is provided with sliding surfaces (21, 22) which rest on the upper and lower boundary walls (9, 10) of the receptacle (8).

13. The setting apparatus according to claim 1, wherein an entrainment element (33) is provided on the setting device (3), which entrainment element causes the displacement of the setting device (3) in the direction of insertion (23) during the insertion of the sign display module (4).

14. The setting apparatus according to claim 1, wherein the setting device (3) is provided at least with one barb (26) which can be latched to a holding opening (27) provided in a lateral boundary wall (11, 12).

15. The setting apparatus according to claim 1, wherein several receptacles (8) are provided.

16. The setting apparatus according to claim 15, comprising a substantially circular housing (2) wherein the receptacles (8) are arranged in a radially extending manner, distributed over the circumference of the housing (2).

17. The setting apparatus according to claim 16, wherein the receptacles (8) end at a distance (34), preferably with a distance identical to the center (35) of the circle.

18. The setting apparatus according to claim 16, wherein the receptacles (8) are open towards the center (35) of the circle.

* * * * *